US008662307B2

(12) United States Patent
Pitt

(10) Patent No.: US 8,662,307 B2
(45) Date of Patent: Mar. 4, 2014

(54) SHOCK-PROTECTING PACKAGING

(75) Inventor: Jeffrey Graham Pitt, Fowey (GB)

(73) Assignee: Protective Packaging Systems Limited, Fowey, Cornwall (GB)

( * ) Notice: Subject to any disclaimer, the term of this patent is extended or adjusted under 35 U.S.C. 154(b) by 202 days.

(21) Appl. No.: 13/123,269

(22) PCT Filed: Oct. 9, 2009

(86) PCT No.: PCT/GB2009/002413
§ 371 (c)(1),
(2), (4) Date: Jun. 2, 2011

(87) PCT Pub. No.: WO2010/041023
PCT Pub. Date: Apr. 15, 2010

(65) Prior Publication Data

US 2011/0220541 A1 Sep. 15, 2011

(30) Foreign Application Priority Data

Oct. 9, 2008 (GB) ..... 0818508.4

(51) Int. Cl.
*B65D 81/05* (2006.01)

(52) U.S. Cl.
USPC ..... 206/586; 206/521; 206/587

(58) Field of Classification Search
USPC ..... 206/586, 521, 453, 523, 587, 451
See application file for complete search history.

(56) References Cited

U.S. PATENT DOCUMENTS 2,863,595 A 12/1958 Emery
3,684,636 A * 8/1972 Rothrock, Jr. ..... 206/326
3,807,622 A * 4/1974 Belcher et al. ..... 206/421
3,868,054 A * 2/1975 Congleton ..... 206/521.1
3,939,978 A * 2/1976 Thomaswick ..... 206/454
3,992,810 A * 11/1976 Kimball ..... 47/77
3,994,433 A * 11/1976 Jenkins et al. ..... 206/586
4,162,729 A * 7/1979 Kaiser et al. ..... 206/592
4,869,369 A * 9/1989 Turngren ..... 206/523
4,883,179 A * 11/1989 Dionne ..... 206/523
5,577,614 A * 11/1996 Palmeroni et al. ..... 206/521
5,729,960 A * 3/1998 Davis ..... 53/458
5,806,683 A * 9/1998 Gale ..... 206/587
6,082,543 A * 7/2000 Beliveau ..... 206/523
6,142,304 A * 11/2000 Moren et al. ..... 206/587

(Continued)

FOREIGN PATENT DOCUMENTS

EP 1777171 A2 4/2007
GB 2414728 A 12/2005
WO 2005/118423 A2 12/2005

*Primary Examiner* — Steven A. Reynolds

(74) *Attorney, Agent, or Firm* — Davis & Bujold, PLLC; Michael J. Bujold

(57) ABSTRACT

A one-piece thermoformed packaging cap for article shock-protection which has two elongate wings integrally hinged and have upstanding shoulders which define a channel that receives part of the article. Ridges and grooves run along the shoulders of each wing such that when the wings are folded abut each other, the ridges and grooves of one wing nest within those of the other wing and provide cushioning and lateral interlocking between the wings. Caps can have four wings and wrap the entire perimeter of the article and may incorporate a locking tab to secure the wrap. Alternatively, an assembly of partial wrap-components can be locked via flap-tabs. For locking, a projection of one wing enters into a recess of another wing, and a locking flap of the latter wing is folded and a projection of the flap is snapped into the reverse recess of the thermoformed projection.

11 Claims, 7 Drawing Sheets

(56) References Cited

U.S. PATENT DOCUMENTS

| | | | | |
|---|---|---|---|---|
| 6,436,217 | B1 * | 8/2002 | Heertjes | 156/206 |
| 6,968,954 | B2 * | 11/2005 | Hsieh | 206/587 |
| 7,134,553 | B2 * | 11/2006 | Stephens | 206/589 |
| 7,743,922 | B2 * | 6/2010 | Pitt | 206/521 |
| 2008/0067105 | A1 * | 3/2008 | Pitt | 206/587 |
| 2009/0230016 | A1 | 9/2009 | Rohrbach et al. | |
| 2011/0233099 | A1 * | 9/2011 | Pitt | 206/521 |

* cited by examiner

SHOCK-PROTECTING PACKAGING

This application is a national stage completion of PCT/GB2009/002413 filed on Oct. 9, 2009 which claims priority from British Application Serial No. 0818508.4 filed on Oct. 9, 2008.

FIELD OF THE INVENTION

This invention relates to packaging and is concerned particularly with packaging for use in protecting articles against damage and shock during storage and transit.

BACKGROUND OF THE INVENTION

Various packaging methods have been used for protecting, for example electronic components, during storage and transit. These methods, in addition to being generally labor-intensive, commonly involve a substantial outlay in cost and material-resources on packaging items in the form, for example, of cardboard cases and specially-designed items of plastics foam and corrugated cardboard to fit within them.

A form of packaging case that may be used with advantage environmentally and economically is described in GB-A-2414728. The rectangular packaging case described is of a thermoformed plastics-sheet construction having four walls that are hinged together to fold from flat in erection of the case round the article or articles to be protected. Although this form of packaging case has been found to be very effective in providing shock protection, some articles such as flat-screen television sets and other heavy domestic electronic products, computer monitors and computers themselves, are in general too large to be accommodated in cases of this form. The present invention is concerned with providing an alternative form of packaging that may be used in these circumstances.

SUMMARY OF THE INVENTION

According to the present invention, there is provided a one-piece thermoformed packaging device for article shock-protection, wherein the device comprises a plurality of elongate wings which are hinged together and which each have upstanding flanges that are spaced apart laterally of the respective wing to define an intervening channel for receiving a portion of the article to be protected from shock.

A portion of each wing may abut a portion of another of the wings when the device is folded about the hinge by which those two wings are hinged together. Ridges with intervening grooves may run longitudinally of the two wings within the mutually-abutting portions for ridge-within-groove nesting between them. The said portions may be inclined portions of the flanges, and may form a mitre joint, for example of 90 degrees, when in mutual abutment.

BRIEF DESCRIPTION OF THE DRAWINGS

Examples of thermoformed packaging devices in accordance with the present invention will now be described with reference to the accompanying drawings, in which.

DETAILED DESCRIPTION OF THE INVENTION

Figure 1:
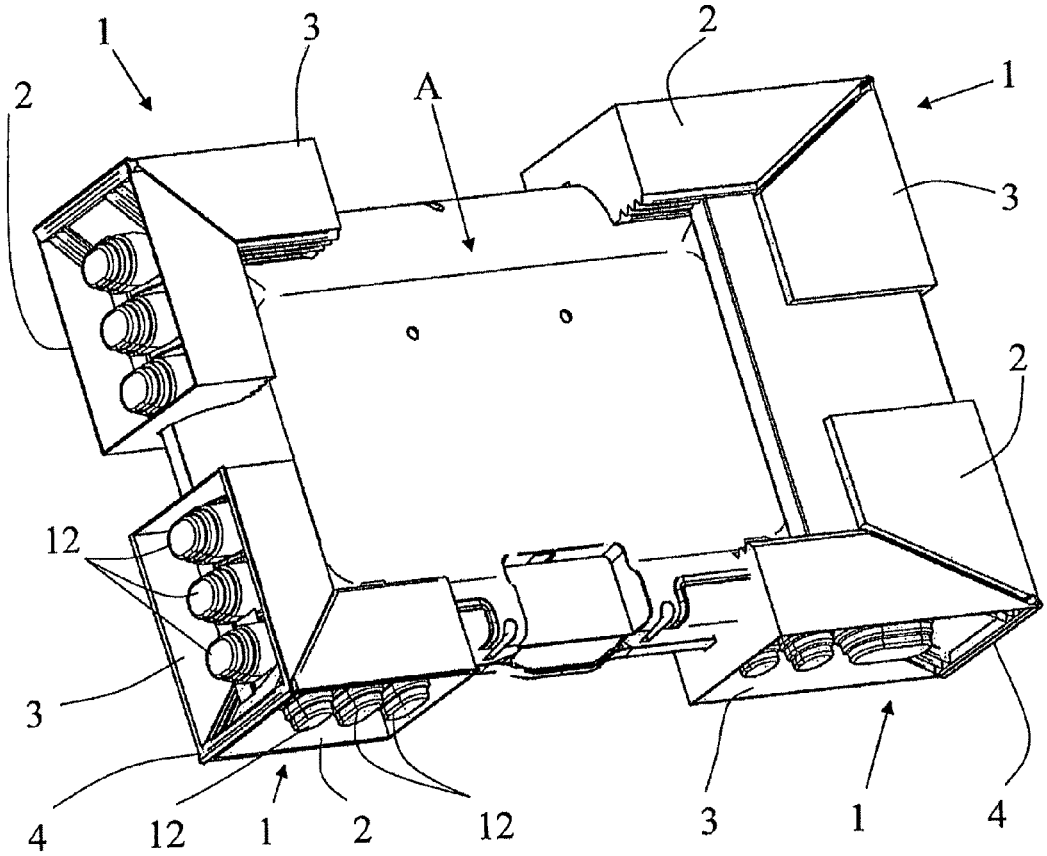
FIG. 1 is a perspective view of an article packaged for shock-protection using a plurality of thermoformed packaging devices in accordance with the present invention.

Referring to FIG. 1, a large and heavy article A (depicted as a computer component in the form of a server drawer in this example) is protected for transportation and storage by four corner caps 1. Each corner cap 1 is a one-piece thermoformed molding (for example of high density polyethylene or polypropylene) that has two rectangular wings 2 and 3 and folds into the L-shape corner form. The folded and unfolded conditions of each corner cap 1 are illustrated in FIGS. 2 and 3 respectively.

Figure 2:
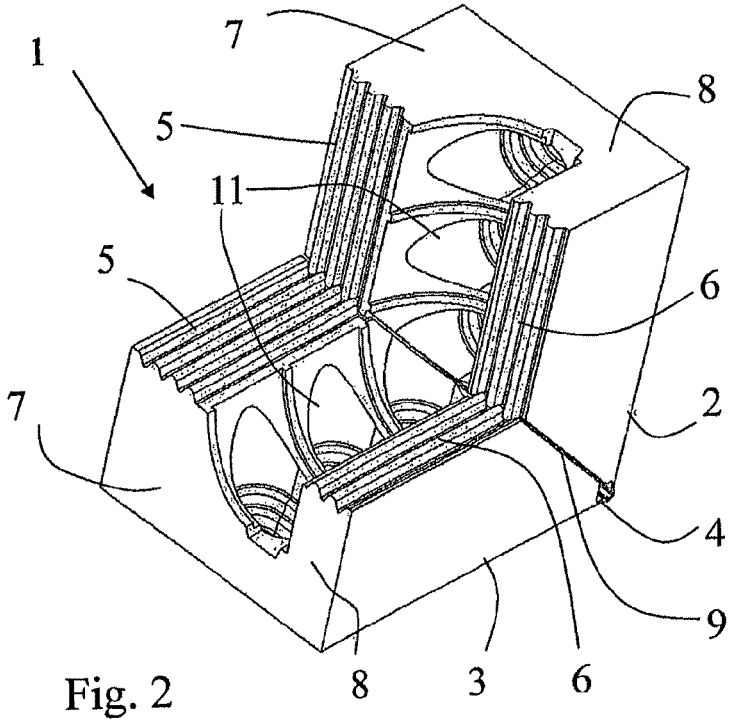
FIG. 2 is a perspective view of one of the thermoformed packaging devices according to the invention used in the arrangement of FIG. 1.
Figure 3:
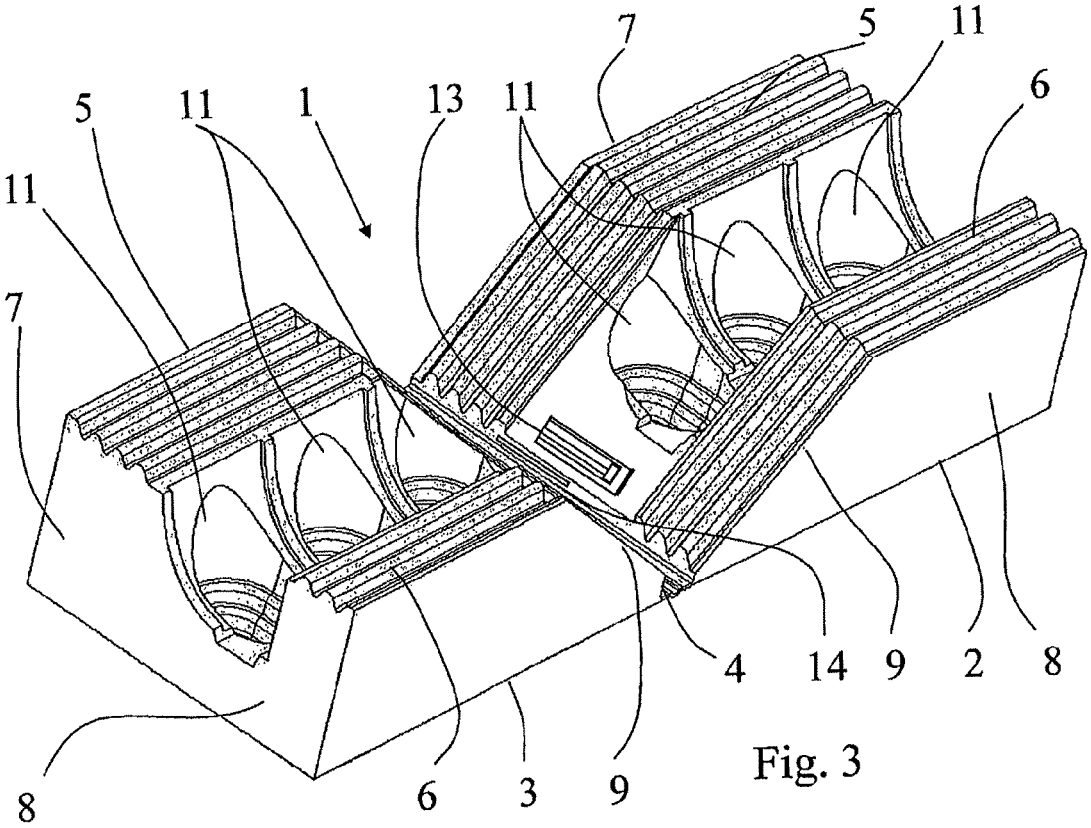
FIG. 3 is perspective view of the thermoformed packaging device of FIG. 2 when folded flat.

Referring now also to FIGS. 2 and 3, the two wings 2 and 3 are interconnected by an integral hinge 4 and on the inside of the molding are each formed along their opposite, longitudinal margins with ridge-groove patterns 5 and 6. The longitudinal margins of each wing 2 and 3 are defined on the inside by a pair of upstanding flanges or shoulders 7 and 8 that rise to full height at 45 degrees throughout an initial, inclined portion 9 of the wing-length from the hinge 4. The ridges with intervening grooves of the patterns 5 and 6 run throughout the full length of the respective shoulders 7 and 8.

Three circular recesses 11 are located between the shoulders 7 and 8 of each wing 2 and 3. Each recess 11 is of tiered form in that its diameter decreases progressively in steps with depth to create resilient projections 12 on the outside of the molding (see FIG. 1) that afford shock-protection.

As shown most clearly in FIG. 2, the wings 2 and 3 fold towards one another on the hinge 4. This brings the two shoulders 7 and 8 of each wing 2 and 3 into abutment with the shoulders 7 and 8 respectively of the other wing, throughout their inclined portions 9 to form a miter joint. The two wings 2 and 3 now extend at right angles to one another and are locked together in this configuration by means of entry and resilient retention of a projection 13 of the wing 2 in a socket 14 of the wing 3. In addition there is interlocking in the abutting portions 9 between the ridge-groove patterns 5 and 6 of the two wings 2 and 3.

More particularly in the latter regard, the ridges and intervening grooves of each ridge-groove pattern 5 and 6 of the wing 3 are shifted laterally by one-half pitch with respect to the corresponding pattern 5 and 6 of the wing 2. As a result the abutment throughout the portions 9 of the wings 2 and 3 is with ridge-within-groove nesting of shoulder 7 with shoulder 7 and shoulder 8 with shoulder 8. This provides interlocking of the two wings 2 and 3 against relative lateral displacement and also cushioning and absorption of shock tending to close up the wings 2 and 3 further onto one another.

Figure 4:
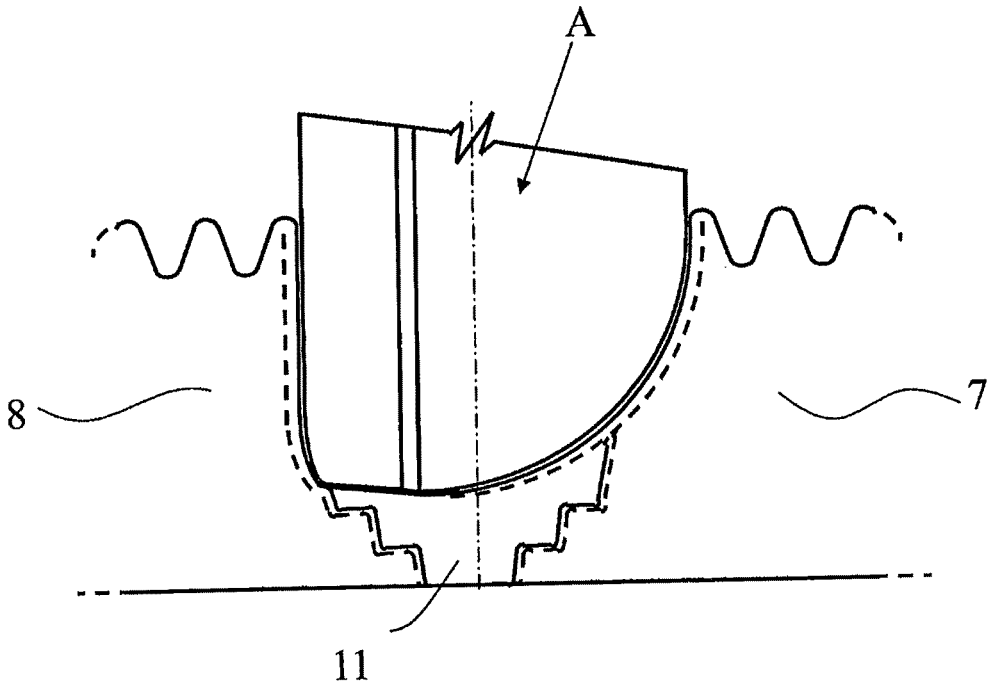
FIG. 4 is a schematic representation to an enlarged scale, illustrative of accommodation of a part of an article within the thermoformed packaging device of FIGS. 2 and 3.

Each corner cap 1 fits to the periphery of the article A as illustrated in FIG. 1, with the corner of the article A received in the channel between the shoulders 7 and 8 of each wing 2 and 3. These channels are generally in mutual alignment but can be configured in the thermoforming to be adapted to the specific profile of the article A to be protected. As shown in FIGS. 2 and 3 by way of example, the channel between the shoulders 7 and 8 is configured in this case to accommodate a portion of the article A of bevelled or curved profile. This is more particularly illustrated schematically to an enlarged scale in the cross-sectional view of FIG. 4, where a profiled corner of article A is represented inserted between shoulders 7 and 8. The shoulder 7 in this case is molded with a scooped-out profile to conform closely to the profile of the article A.

Figure 5:
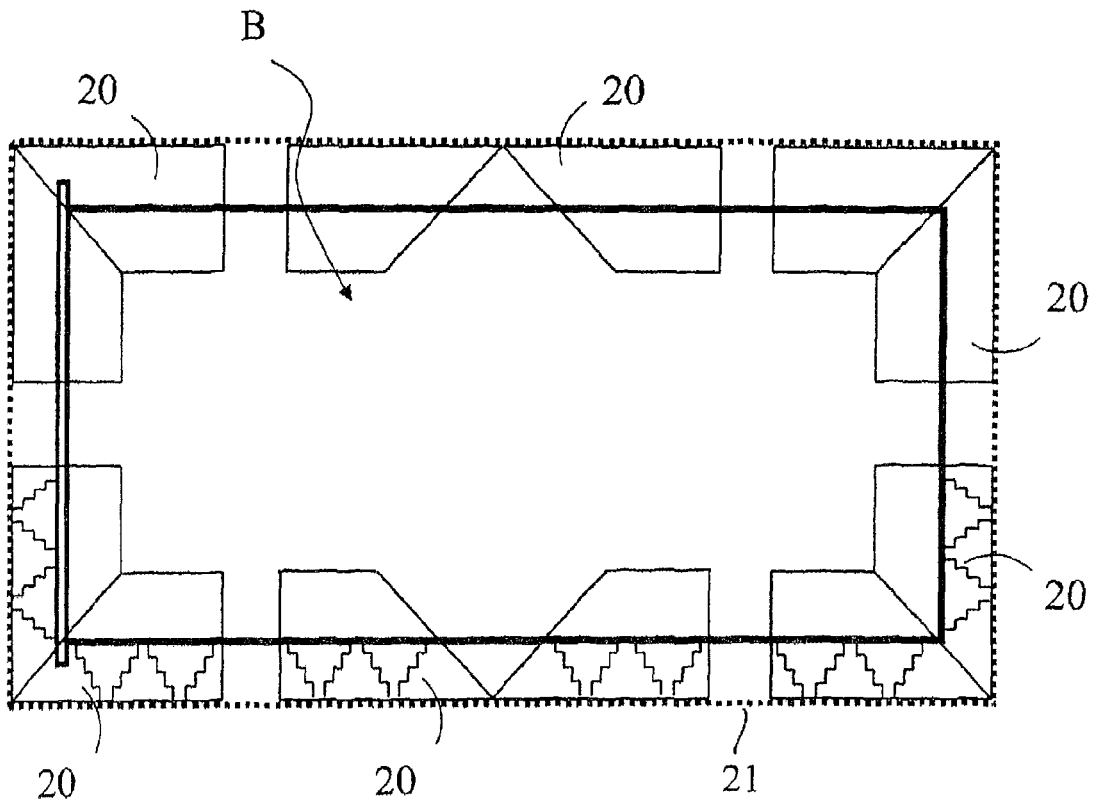
FIGS. 5 to 10 are further illustrative of the way in which thermoformed devices according to the present invention may be used for article shock-protection.

Caps of the same general form (including with ridge-groove patterns corresponding to the patterns 5 and 6 in miter-joints) of the cap 1 can be utilized for protection other than in the context of corners. In this respect, reference is directed to FIG. 5 where a long, rectangular article B is protected at its corners by folded corner caps 20, and along its longer sides by identical, but unfolded, caps 20, all within a lightweight carton 21. The unfolded caps 20 give protection to the sides of the article B in the space between the folded, corner caps 20, being simply pushed onto the sides in the same way as the folded caps 20 are pushed onto the corners.

Figure 6:
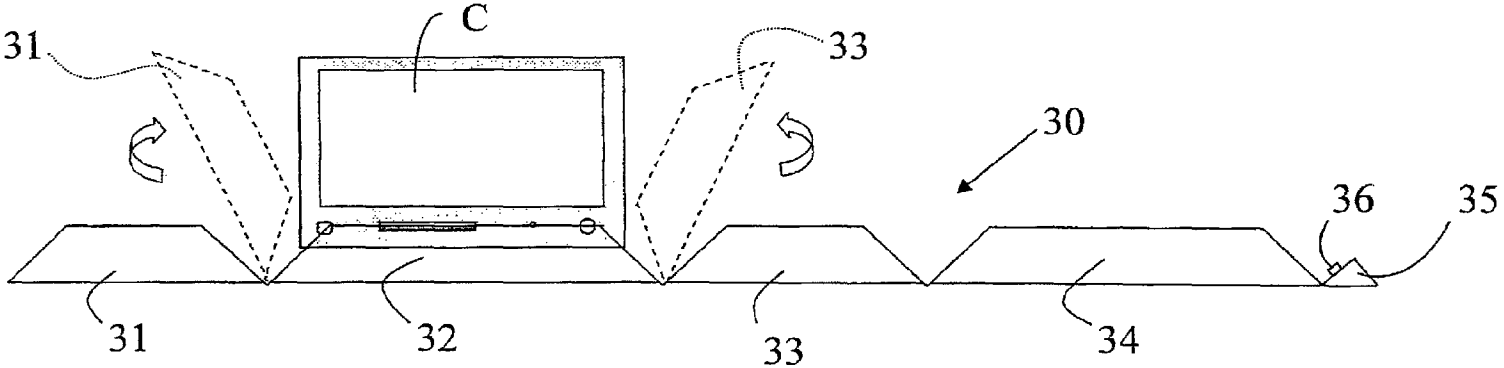
Figure 8:
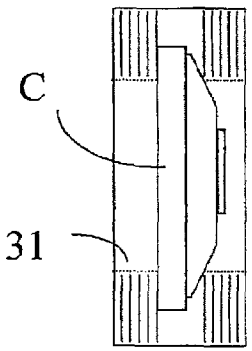
Figure 7:
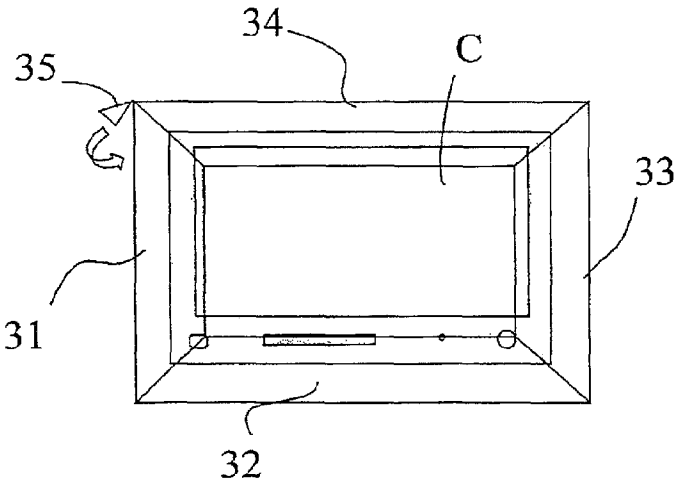

As an extension of this, a wrap for article-protection within, for example, a lightweight cardboard or other container, can be produced as illustrated in FIGS. 6 to 8 of the accompanying drawings. FIG. 6 shows in front view a thermoformed wrap 30 composed of four wings 31 to 34 that are hinged together for use in enclosing a computer monitor C to provide it with surround-protection. The base of the monitor C is first entered into the wing 32 ready for wrapping the wings 31 and 33 up round it and the wing 34 over the top to give the result illustrated by FIGS. 7 and 8.

Each of the wings 31 to 34 is molded with a configuration similar to that of each of the wings 2 and 3 of the corner caps 1 described above, but of increased length related to the breadth and height of the monitor C. The wings 31 to 34 have inclined faces at both ends so that mitered joints between them together with ridge-within-groove nesting, are established at the corners of the monitor C as the wings 31, 33 and 34 are folded up round it.

Figure 9:
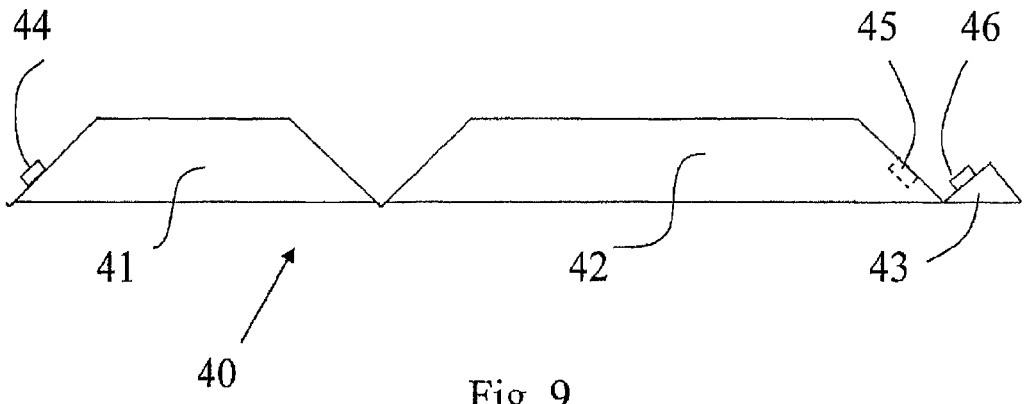

Retention of the wings 31 to 34 wrapped round the perimeter of the monitor C is by a locking tab 35 which is hinged to the free end of wing 34 and which involves a stud 36 that is entered and retained resiliently within a cavity (not shown) in the wing 31.

Where the article to be protected is very large it is often not feasible to design and manufacture a wrap capable of extending throughout the full perimeter. In these circumstances a complete peripheral wrap may be produced by assembly together end-to-end of a plurality of thermoformed wrap-components that each comprise two or more hinged wings. An example of a component 40 of this nature that is made up of just two mutually-hinged wings 41 and 42 with a locking tab 43 hinged to the wing 42, is illustrated in FIG. 9. Ridge-within-groove nesting is provided in the mitered joints between the wings 41 and 42.

Figure 10:
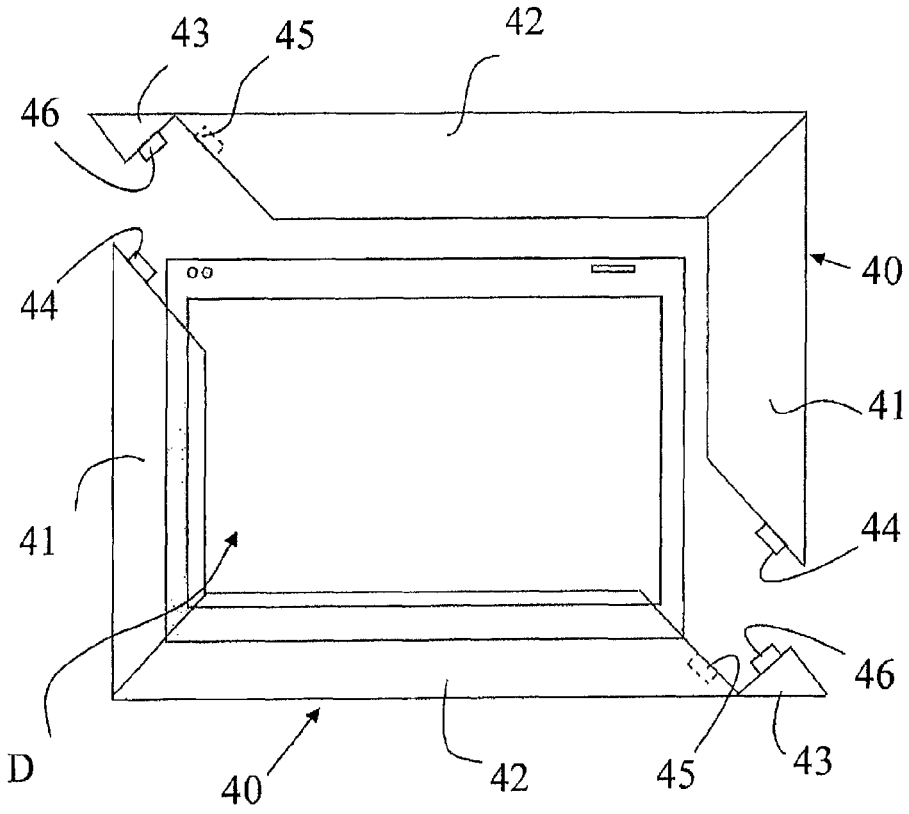

FIG. 10 shows two of the components 40 in the process of being used to provide a peripheral-wrap of a television set D. The set D is shown standing in the wing 42 of the lower of the two components 40 with its left-hand side (as seen in FIG. 10) entered in the folded-up wing 41. The other component 40 is shown ready to be lowered onto the top of the set D to have the top of the set D entered in the wing 42 and its other side entered in the wing 41. Once this has been accomplished, the two components 40 are locked together using the locking tabs 43 at each of the two diagonally-opposite corners of the set D. The locking at each corner is carried out in the three-stage sequence illustrated at (a) to (c) of FIG. 11.

Figure 11:
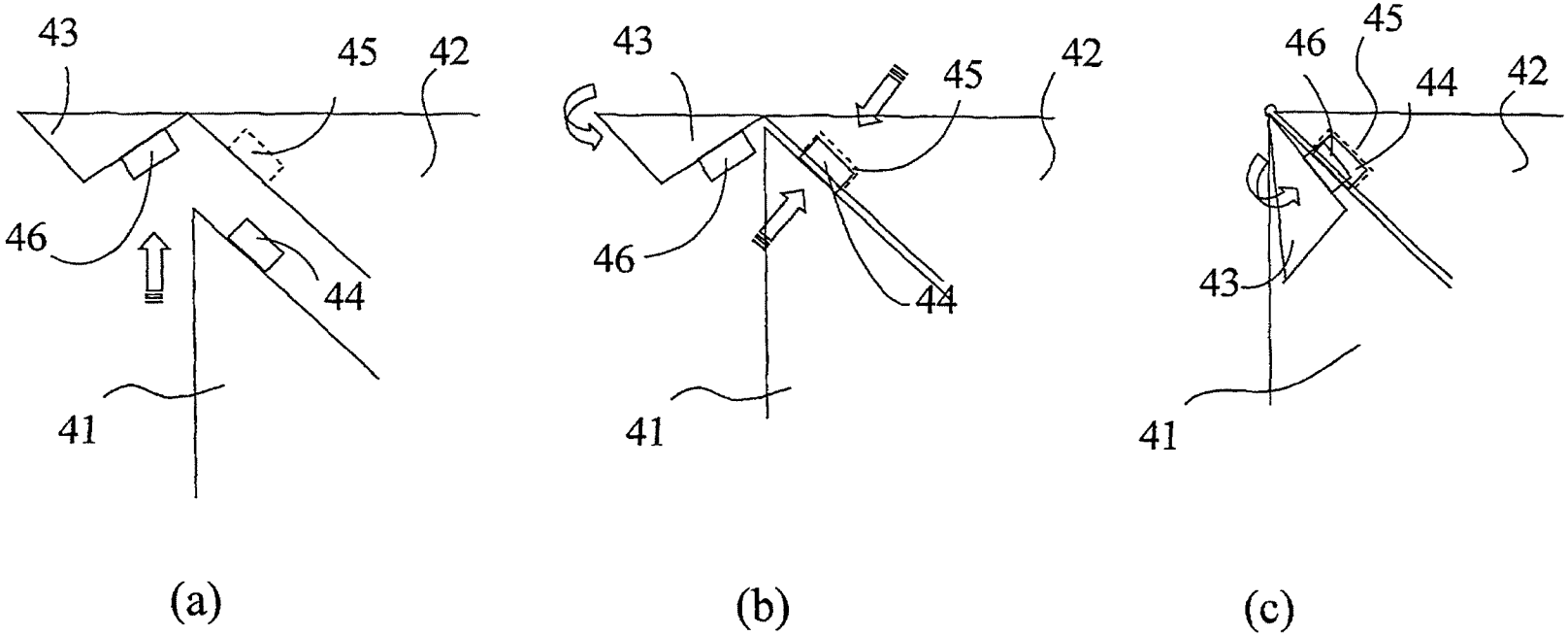
FIG. 11 is illustrative at (a) to (c) of a three-stage sequence used for locking together components illustrated and described below with reference to FIGS. 9 and 10.

The three-stage locking sequence is illustrated in FIG. 11 and will be described in the context of the locking of the upper of the two corners; the locking at the other corner is carried out in a corresponding way.

Referring to stage (a) of FIG. 11, the bringing together of the wings 41 and 42 of the two components 40 respectively, is accompanied by entry of a projection 44 of the wing 41 of the lower of the two components 40 into a recess 45 in the wing 42 of the upper component 40. With the projection 44 pushed fully home within the recess 45 as illustrated for stage (b) of FIG. 11, the locking flap 43 hinged to the wing 42, is folded over to overlap the junction with the wing 41. Stage (c) of FIG. 11 illustrates the folding down of the flap 43 further to bring a projection 46 that projects from the underside of the folded-over flap 43, aligned with the projection 44 pushed into the recesses 45. More especially, the alignment brings the projection 46 facing into the reverse recess of the thermoformed projection 44. Finally, the projection 46 is pushed home into the recesses 43 for resilient retention there locking the flap 43 down and locking the two components firmly together. Retention of this condition is enhanced by virtue of the projection 46 being an interference fit with a snap action into the reverse recess; the snap action is facilitated by the resilience of the thermoformed material.

The invention claimed is:

1. A one-piece thermoformed packaging device for article shock-protection, the packaging device being a unitary thermoformed molding, wherein the one-piece thermoformed molding comprises first and second elongate molding wings, and an integral hinge which is integral with the first and the second elongate molded wings as part of the unitary thermoformed molding, the integral hinge hinges the first and the second elongate molded wings together for folding the first and the second elongate molded wings onto one another about the integral hinge to bring an abutment-part of the first elongate molded wing into mutual abutment with an abutment-part of the second elongate molded wing, and each of the first and the second elongate molded wings has a pair of upstanding flanges as part of the unitary thermoformed molding, the upstanding pair of flanges of each of the first and the second elongate molded wings are spaced apart laterally from one another of the respective wing to define between them an intervening channel for receiving a portion of an article to be shock-protected, a first molded pattern of ridges with intervening grooves runs longitudinally of the abutment-part of the first elongate molded wings and a second molded pattern of ridges with intervening grooves runs longitudinally of the abutment-part of the second elongate molded wing, the first molded pattern of ridges with intervening grooves of the abutment-part of the first elongate molded wing nesting ridge-within-groove with the ridges with intervening grooves of the second molded pattern of ridges with intervening grooves of the abutment-part of the second elongate molded wing when the first and the second elongate molded wings are folded onto one another about the integral hinge into mutual abutment with one another.

2. The one-piece thermoformed packaging device according to claim 1, wherein the abutment-part of each of the first and the second elongate molded wings comprises inclined abutment-parts of the pair of upstanding flanges of the respective elongate molded wing.

3. The one-piece thermoformed packaging device according to claim 2, wherein the inclined abutment-parts of the flanges of the first elongate molded wing forms a mitre joint with the inclined abutment-part of the second elongate molded wing when the first and the second elongate molded wings are folded onto one another about the hinge into mutual abutment with one another.

4. The one-piece thermoformed packaging device according to claim 3, wherein the mitre joint is a 90-degree joint between the first and the second elongate molded wings.

5. The one-piece thermoformed packaging device according to claim 1, wherein the intervening channel of the first elongate molded wing is in alignment with the intervening channel of the second elongate molded wing.

6. The one-piece thermoformed packaging device according to claim 1, wherein each of the first and the second elongate molded wings has a recess within the intervening channel of the respective elongate molded wing to afford shock-protection.

7. The one-piece thermoformed packaging device according to claim 6, wherein the recess is a recess of tiered form, the recess of tiered form having a cross-section that reduces with depth within the recess to afford resilience.

8. The one-piece thermoformed packaging device according to claim 1, wherein the first elongate molded wing has a locking-flap hinged to the first elongate molded wing and an adjacent locking-recess, and the second elongate molded wing has a locking-projection on the second elongate molded wing, the locking-flap and the locking-projection are located at opposite extremities of the one-piece thermoformed device from one another, and the locking-flap has a locking-projection thermoformed thereon, and the locking-projection of the second elongate molded wing is thermoformed to define a reverse recess thereto on the second elongate molded wing.

9. In combination, first and second one-piece thermoformed packaging devices each according to claim 8, wherein the first and the second packaging devices are for locking closure with one another in which the projection of the second elongate molded wing of the second packaging device is entered into the locking-recess of the first elongate molded wing of the first packaging device on closing together of the first and the second packaging devices, and the locking-projection on the hinged locking-flap of the first elongate molded wing of the first packaging device snaps resiliently into the reverse recess of the second molded elongate wing of the second packaging device to retain the first and the second packaging devices in mutual locked closure.

10. A one-piece thermoformed packaging device for article shock-protection, the packaging device being a unitary thermoformed molding, wherein the unitary thermoformed molding comprises at least three elongate molded wings, and integral hinges which are each integral with the at least three elongate molded wings as part of the unitary thermoformed molding, the integral hinges hinge the elongate molded wings together in respective pairs of first and second elongate molded wings for folding the first and the second elongate molded wings of each individual pair onto one another about an individual one of the integral hinges to bring an abutment-part of the first elongate molded wing into mutual abutment with an abutment-part of the second elongate molded wing, and each of the elongate molded wings has a pair of upstanding flanges as part of the unitary thermoformed molding, the upstanding pair of flanges of each elongate molded wing are spaced apart laterally from one another of the respective wing to define between them an intervening channel for receiving a portion of an article to be shock-protected, a first molded pattern of ridges with intervening grooves runs longitudinally of the abutment-part of the first elongate molded wing of each pair of elongate molded wings, and a second molded pattern of ridges with intervening grooves runs longitudinally of the abutment-part of the second elongate molded wing of each pair of elongate molded wings, the first molded pattern of ridges with intervening grooves of the abutment-part of the first elongate molded wing of each of the pairs of wings nesting ridge-within-groove with the pattern of ridges with intervening grooves of the abutment-part of the second elongate molded wing of the respective pair when the first and the second elongate molded wings of that pair are folded onto one another about their individual integral hinge.

11. The one-piece thermoformed packaging device according to claim 10, wherein the first elongate molded wing of a pair of elongate molded wings at a first extremity of the packaging device has a hinged locking-flap and an adjacent locking-recess, and the second elongate molded wing of a pair of elongate molded wings at a second extremity of the packaging device has a locking-projection, and the hinged locking-flap of the first elongate molded wing of the pair of elongate molded wings at the first extremity of the packaging device has a locking-projection thermoformed thereon, and the locking-projection of the second elongate molded wing of the pair of elongate molded wings at the second extremity of the packaging device is thermoformed to define a reverse recess thereto, and the first and second elongate molded wings of the pairs of elongate molded wings at the first and the second extremities of the packaging device are for locking closure with one another in which the projection of the second elongate molded wing of the pair of elongate molded wings at the second extremity of the packaging device is entered into the locking-recess of the first elongate molded wing of the pair of elongate molded wings at the first extremity of the packaging device, and the locking-projection on the hinged locking-flap of the first elongate molded wing of the pair of elongate molded wings at the first extremity of the packaging device snaps resiliently into the reverse recess of the second elongate molded wing of the pair of elongate molded wings at the second extremity of the packaging device.

* * * * *